US010421107B2

(12) United States Patent
Denton et al.

(10) Patent No.: US 10,421,107 B2
(45) Date of Patent: Sep. 24, 2019

(54) ROLLER TABLE APPARATUS AND METHOD OF USING ROLLER TABLE APPARATUS

(71) Applicant: Primetals Technologies, Limited, London (GB)

(72) Inventors: Nigel Denton, Sheffield (GB); Daniel Hague, Sheffield (GB); Stuart Leflay, Sheffield (GB)

(73) Assignee: PRIMETALS TECHNOLOGIES, LIMITED (GB)

( * ) Notice: Subject to any disclaimer, the term of this patent is extended or adjusted under 35 U.S.C. 154(b) by 0 days.

(21) Appl. No.: 15/776,569

(22) PCT Filed: Nov. 28, 2016

(86) PCT No.: PCT/EP2016/079020
§ 371 (c)(1),
(2) Date: May 16, 2018

(87) PCT Pub. No.: WO2017/108340
PCT Pub. Date: Jun. 29, 2017

(65) Prior Publication Data

US 2018/0326467 A1 Nov. 15, 2018

(30) Foreign Application Priority Data

Dec. 21, 2015 (GB) ..... 1522549.3

(51) Int. Cl.
*B65G 39/12* (2006.01)
*B65G 15/08* (2006.01)
(Continued)

(52) U.S. Cl.
CPC ..... *B21B 39/12* (2013.01)

(58) Field of Classification Search
None
See application file for complete search history.

(56) References Cited

U.S. PATENT DOCUMENTS 3,701,411 A * 10/1972 McGinnis ..... B65G 15/56 198/303
4,502,310 A 3/1985 Gnutov et al. ..... 72/69
(Continued)

FOREIGN PATENT DOCUMENTS

CN 201150936 Y 11/2008
CN 201669279 U 12/2010
(Continued)

OTHER PUBLICATIONS

International Search Report dated Feb. 14, 2017 in corresponding PCT International Application No. PCT/EP2016/079020.
(Continued)

*Primary Examiner* — Kavel Singh
(74) *Attorney, Agent, or Firm* — Ostrolenk Faber LLP

(57) ABSTRACT

Roller table apparatus (200; 300) for transporting a metallic product (P) to or from a mill stand, includes: first and second rolls (202*a*, 202*b*; 302*a*, 302*b*), outboard ends of the rolls are supported by respective outboard bearings and inboard ends of the rolls are supported by respective inboard bearings, such that each of the rolls is rotatable about its longitudinal axis (X1, X2); and at least one adjuster (216; 316*a*, 316*b*), movable in use to displace at least one end of the rolls or the respective bearings of the roll so as to adjust an angle (α) of inclination of each of the longitudinal axes of the rolls with respect to a datum (D), thereby to adjust a pass-line height (h1, h2) of the product relative to the datum.

21 Claims, 5 Drawing Sheets

(51) Int. Cl.

| | |
|---|---|
| ***B65G 15/40*** | (2006.01) |
| ***B21B 39/12*** | (2006.01) |

(56) References Cited

U.S. PATENT DOCUMENTS

| | | | | |
|---|---|---|---|---|
| 5,911,301 | A * | 6/1999 | Ozawa | B23P 19/086 198/345.3 |
| 7,181,845 | B2 * | 2/2007 | Roessler | B65G 39/02 29/895 |
| 9,346,622 | B2 * | 5/2016 | Kuiper | B65G 15/64 |
| 2001/0013462 | A1 * | 8/2001 | Malmberg | B65G 39/16 198/836.3 |

FOREIGN PATENT DOCUMENTS

| | | | |
|---|---|---|---|
| CN | 201676898 | U | 12/2010 |
| CN | 102773269 | A | 11/2012 |
| GB | 981628 | A | 1/1965 |
| GB | 1120829 | A | 7/1968 |
| JP | S57-85609 | A | 5/1982 |
| JP | H06-246324 | A | 9/1994 |
| KR | 10-2013-0034967 | A | 4/2013 |
| SU | 1375368 | A1 | 2/1988 |

OTHER PUBLICATIONS

Written Opinion dated Feb. 14, 2017 in corresponding PCT International Application No. PCT/EP2016/079020.
Combined Search and Examination Report dated Feb. 16, 2016 in corresponding United Kingdom Patent Application No. 1522549.3.

* cited by examiner

ROLLER TABLE APPARATUS AND METHOD OF USING ROLLER TABLE APPARATUS

CROSS-REFERENCE TO RELATED APPLICATIONS

The present application is a 35 U.S.C. §§ 371 national phase conversion of PCT/EP2016/079020, filed Nov. 28, 2016, which claims priority of United Kingdom Patent Application No. 1522549.3, filed Dec. 21, 2015, the contents of which are incorporated by reference herein. The PCT International Application was published in the English language.

TECHNICAL FIELD

The present invention relates to roller table apparatus for transporting a metallic product to or from a mill stand.

TECHNICAL BACKGROUND

In hot roughing mills and plate mills, roller tables at either side of the mill stand are used to transport the product and to support the product during the rolling process.

In steel hot rolling, the roller tables usually use cylindrical rolls which support the product across its full width. But, in aluminium hot rolling, the material is much more easily damaged, scratched or stained by contact between the bottom surface of the product and the rolls of the tables. Also, in aluminium rolling, there is usually no surface treatment between hot and cold rolling and so the hot rolled surface quality has a major influence on the final product quality. In contrast, in steel rolling, there is usually a pickling treatment between hot and cold rolling to remove scale and clean the surface. Consequently, in the conventional aluminium hot rolling process, the product is normally only supported at the edges so that most of the bottom surface of the product is not in contact with the rolls.

Referring to FIGS. 1*a* and 1*b*, in order to ensure that the product P only contacts the rolls at the edges, hot aluminium mill roller tables 100 usually use either double tapered rolls 102*a*, 102*b* (FIG. 1*a*) or inclined half-width cylindrical rolls 104*a*, 104*b* (FIG. 1*b*). In the case of tapered rolls 102*a*, 102*b*, the taper sometimes has a compound form with different taper angles in different sections of the roll but the principle is still the same. The taper angle or inclination angle of the rolls 102*a*, 102*b*; 104*a*, 104*b* is typically between 1.3 and 3.6 degrees from the horizontal, depending on the final product thickness, width and strength at the rolling temperatures, as discussed in more detail later herein.

In most aluminium mills, tapered solid rolls, usually manufactured from single piece forgings, are used near to the mill stand because these rolls have to handle the impact forces and loads from the thick slabs. Further from the hot mill the product is thinner and hence half width inclined tubular cylindrical rolls are used.

However, there are a number of problems with using tapered or inclined cylindrical rolls. Referring now to FIG. 2, a problem that is common to the use of both tapered and inclined cylindrical rolls is that the pass-line height h1, h2 (i.e. the height of the bottom surface of the product above floor level, or datum D) varies with the width of the product P1, P2. This is an issue for the design of the other rolling mill equipment, such as the rolling mill stand and the shears, because different width products P1, P2 are delivered to the equipment at different pass-line heights h1, h2. Clearly, the larger the taper (or inclination) angle $\alpha$ of the rolls the greater is the variation of pass-line height with product width.

In addition to the pass-line height problem, tapered rolls suffer from problems due to the differences in roll peripheral (circumferential/surface) speed along the taper. One issue is that if the product is not on the center line, then the difference in speed at the two edges can cause the product to skew.

Inclined cylindrical half-width rolls do not have any problems with differences in peripheral speed along the roll but one of the issues with inclined cylindrical rolls is the drive mechanism. Referring again to FIG. 1*b*, the most common method for lighter duty roller tables 100 with tubular rolls is to use separate motors M1, M2 for each half-width roll 104*a*, 104*b*. However, clearly the cost of having two motors per roll instead of one is a significant disadvantage.

Another method is to group several half rolls together on each side by roller chains, toothed belts or gears and use one motor on each side per group. But all of these methods of driving multiple rollers from one motor suffer from reliability issues and hence mills generally prefer individually driven rollers.

According to CN201150936, another solution that has been used is to connect the two half width rolls via a drive coupling which will accommodate a small angle between the rolls so that only one drive per pair of half width rolls is required. A problem with this arrangement is that standard gear-type couplings are generally only suitable for small angles (typically 2 to 3 degrees across the joint—which implies that the each half roll can only have an angle relative to the horizontal of only 1 to 1.5 degrees). As discussed later herein, particularly for wider and thinner material, roll angles of only 1 to 1.5 degrees may not be sufficient. Other types of joints which can accommodate bigger angles (e.g. Hooke's type joints) could be used but these produce cyclical variations in the relative velocity of the two half rolls which is not desirable.

A further complication occurs in the case of so-called 1+1 mills. In a 1+1 or similar mill there is often a wide (typically 3 to 4 m wide but possibly wider) plate/roughing mill stand and one or more narrower (typically 2 to 3 m wide) finishing mill stands. This type of mill produces two different products: plate products and strip products. In both cases, the rolling process starts with cast and scalped slab which can be up to 800 mm thick. For the strip products, the roughing/plate mill stand rolls a transfer bar (typically 20 to 60 mm thick) which then gets transported to the finishing mill stand for further rolling in coil form. ("Transfer bar" is the name given to the partially rolled product which is transferred from the roughing mill to the finishing mill, i.e. the roughing mill rolls the slab down to 20 to 60 mm and then the finishing mill rolls it down to final thickness). For the plate products, the finish rolling is carried out in the roughing/plate stand and the plate product could be as thin as 10 mm or even thinner.

In the case of the strip product, the surface finish is extremely critical and any contact between the bottom surface of the transfer bar and the roller table would result in material being scrapped. Therefore, it is very important to ensure that the transfer bar is only supported at the edges.

The critical consideration is the amount of sag of the transfer bar across its width when it is supported at the edges. The amount of sag depends on the width, thickness, temperature and grade of the material. Furthermore, because aluminium is typically hot rolled at relatively high temperatures relative to the melting point, typically between 550 and 300 degrees Celsius, material creep increases the sagging of the product especially at the end of long transfer bars. Furthermore, other forces acting on the product, such as the forces from centring guides and the impact forces between the product head end and the roller table rolls, can also increase the sagging of the product locally.

To ensure that even the thinnest and widest transfer bars do not make contact with the rolls except at the edges, mill designers calculate the optimum taper or inclination angle for the particular product range of the mill. Typically, for transfer bars, the optimum angle is relatively large—up to around 3.6 degrees depending on the final product thickness, width and strength at the rolling temperatures. Very often the mill designer also specifies a minimum transfer bar thickness dependent on width to ensure that the sagging of the product is not sufficient to contact the roll surface either in the center or inboard of the edges. However, limiting the minimum transfer bar thickness for the wider products is not ideal because this increases the load and power required in the finishing mill stand.

Another issue is that if the products that are rolled are changed during the lifetime of a rolling mill, then the angle might not be sufficient in the future. Of course, the roller table could be designed with even larger taper or inclination angles so that even thinner and wider transfer bars could be rolled. But, large angles exacerbate the problems discussed earlier; variation in pass-line height with width, speed differentials for taper rolls and the difficulty of driving half-width inclined rollers with single motors per pair. Therefore, the angle is usually chosen to be large enough for the anticipated products but no larger.

A complication that arises with 1+1 mills is that the thinnest and widest plate products sag so much that they would make contact with the rolls inboard of the strip edge even if very steep angles were used because the material is so thin and wide that it cannot support itself from the edges only. This is because the thinnest plate products, e.g. 10 mm, have only about half the thickness of the thinnest transfer bars and are also much wider, e.g. 4 m instead of 2 m. Consequently, dedicated plate mills, which might be expected to use larger taper or inclination angles because of the thinner and wider product, actually use relatively small angles and some contact inboard of the strip edge on the thinner and wider products is accepted. The use of smaller angles minimizes the pass-line height differences; if large angles were used on a plate mill, the pass-line height variations could be very large because of the much wider range of widths that are rolled. Also, in the case of tapered rolls, the use of small angles ensures that the peripheral speed differences (e.g. between contact points in the center and the edge) are minimized and this minimizes scratching and damage to the bottom surface. So, a problem with a 1+1 mill is that if the optimum (large) angle is selected for rolling transfer bars, this would result in very large pass-line height variations for plate products (and large differences in peripheral speed for tapered rolls). Whereas, if the optimum (small) angle were selected for plate products, then the minimum transfer bar thickness that could be rolled without bottom surface contact would be significantly thicker than the optimum.

A solution proposed by CN102773269 is the use of separate, movable central rollers. The idea is that for thin and wide plate these central rollers are raised to support the plate so that it does not sag. However, this solution is not ideal because the small contact area of this central roller is highly likely to cause surface damage especially because that roller is not driven. It could be driven of course, but this would introduce even more complexity.

A further complication that arises with 1+1 mills is that they might have sections of roller table with two different widths; for example wide roller tables suitable for plate product either side of the roughing/plate stand and narrower tables close to the finishing stand. If these two roller tables have different angles (e.g. relatively steep angles for transfer bars on the narrow table and relatively shallow angles for the wide tables) then there will be a mismatch in pass-line height between the two sections of table depending on the product width.

JP H06 246324 A discloses a roller table apparatus for transporting a metallic product comprising first and second rolls, and outboard ends of the rolls being supported by respective outboard bearings and inboard ends of the rolls being supported by respective inboard bearings.

Furthermore, at least one adjuster is disclosed to displace the rolls so as to adjust an angle of inclination of each of the longitudinal axes of the rolls with respect to the other and thereby to adjust a pass-line height of the product relative to a datum.

In view of the above, it would be desirable to avoid marking, scratching, or staining of the bottom surface of the product, to minimize pass-line height variation and preferably peripheral speed differences, and to accommodate table rolls with different lengths while still maintaining the same profile of the roll top surface.

SUMMARY OF THE INVENTION

The present invention aims to alleviate at least to some extent one or more of the problems of the prior art.

According to an aspect of the invention, there is provided roller table apparatus for transporting a metallic product to or from a mill stand, comprising: first and second rolls, outboard ends of the rolls supported by respective outboard bearings and inboard ends of the rolls supported by respective inboard bearings, such that each of the rolls is rotatable about its longitudinal axis; and at least one adjuster, movable in use to displace the rolls so as to adjust an angle of inclination of each of the longitudinal axes of the rolls with respect to a datum, thereby to adjust a pass-line height of the product relative to the datum.

Thus the invention provides "variable angle" rolls whose inclination can be adjusted (by, primarily vertical, displacement) in order to alter the height of the metallic product above the ground (or other datum), thereby advantageously providing a reduction in pass-line height variation with product width. Preferably the rolls are cylindrical rolls, but it will be understood that rolls having different shapes could be used, for example tapered rolls.

The first and second rolls may be arranged in line such that the respective longitudinal axes of the rolls lie on a common plane. Or, the first and second rolls may be spaced apart such that the respective longitudinal axes of the rolls lie in parallel planes.

The roller table apparatus may comprise a pivotable support frame which supports the rolls and is arranged to pivot in order to accommodate the displacement of the rolls. The pivotable support frame may be connected to the at least one adjuster.

The at least one adjuster may be located at a central portion of the pivotable support frame so as to displace the inboard ends of the rolls. Or, the roller table apparatus may comprise first and second adjusters, which are located at respective first and second outboard portions of the pivotable support frame so as to displace the outboard ends of the rolls. Or, the roller table apparatus may comprise: a first adjuster, located at a central portion of the pivotable support frame so as to displace the inboard ends of the rolls; and second and third adjusters, located at respective outboard portions of the pivotable support frame so as to displace the outboard ends of the rolls.

The roller table apparatus may comprise a self-aligning bearing housing which houses the inboard bearings and is arranged to accommodate the displacement of the rolls. Or, the inboard bearings may be mounted on respective inboard portions of the pivotable support frame and the at least one adjuster then arranged to accommodate the displacement of the rolls.

The roller table apparatus may comprise at least one actuator for moving the at least one adjuster to displace the rolls.

The rolls may be of solid construction or the rolls may be of hollow construction.

The roller table apparatus may comprise at least one motor arranged to rotate the rolls. The motor may be located on the pivotable support frame or on an extension thereof.

The rolls may be connected by a constant velocity joint. The roller table apparatus may comprise a splined connection between the rolls for accommodating axial movement of the rolls caused by the displacement.

According to another aspect of the invention, a roller table is provided for use with a mill stand, comprising plural roller table apparatus as described above.

According to another aspect of the invention, a method of using roller table apparatus as described above is provided. The method comprises moving the adjuster in order to adjust a roller table angle according to one or more of the width, thickness, grade, and temperature, of the metallic product.

BRIEF DESCRIPTION OF THE DRAWINGS

Embodiments will now be described, by way of example, with reference to the accompanying figures in which.

DESCRIPTION OF EMBODIMENTS OF THE INVENTION

Figure 1A:
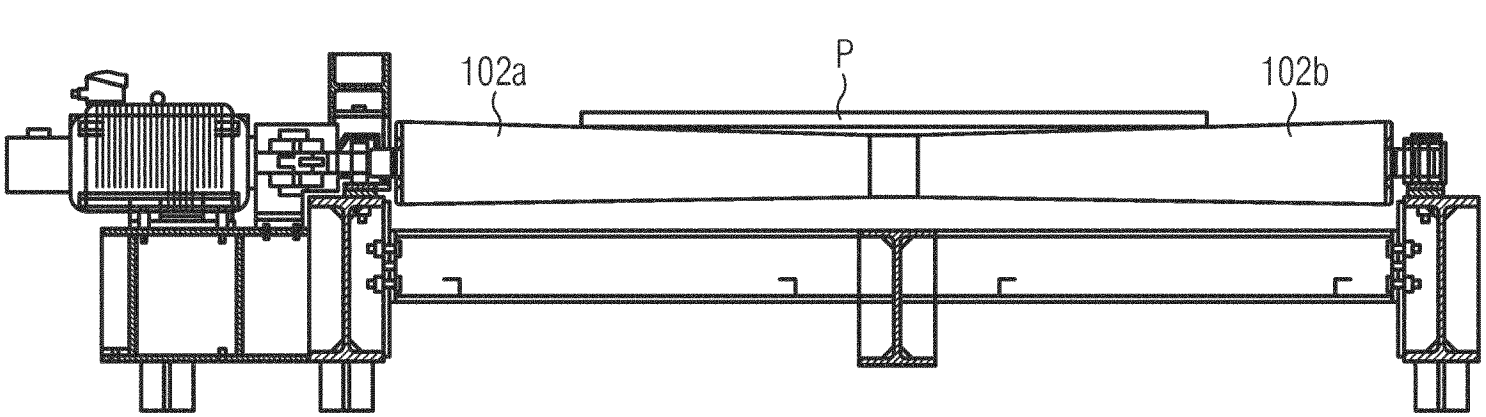
FIG 1a Prior art
FIGS. 1*a* and 1*b* show conventional roller table apparatus.
Figure 1B:
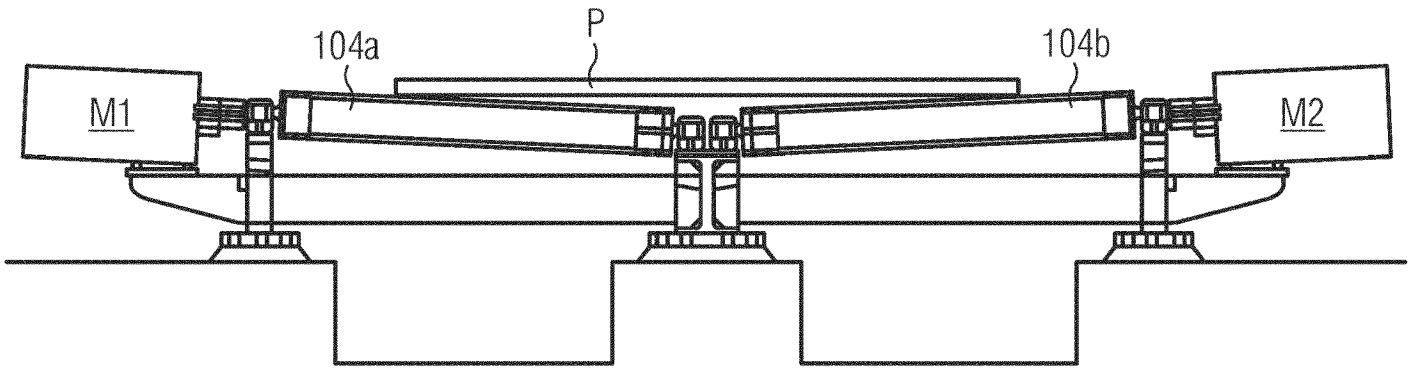
FIG 1b Prior art
Figure 2:
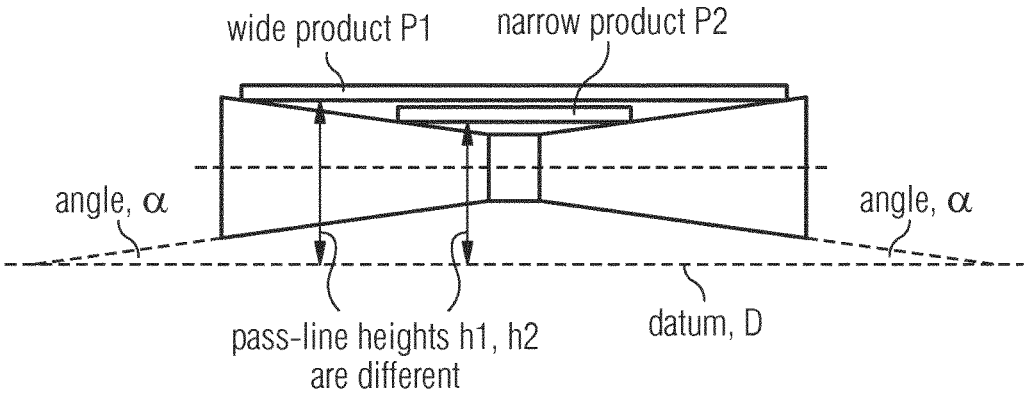
FIG 2 Prior art
FIG. 2 illustrates the conventional roller table apparatus of FIG. 1*a* in conjunction with a product.
Figure 3A:
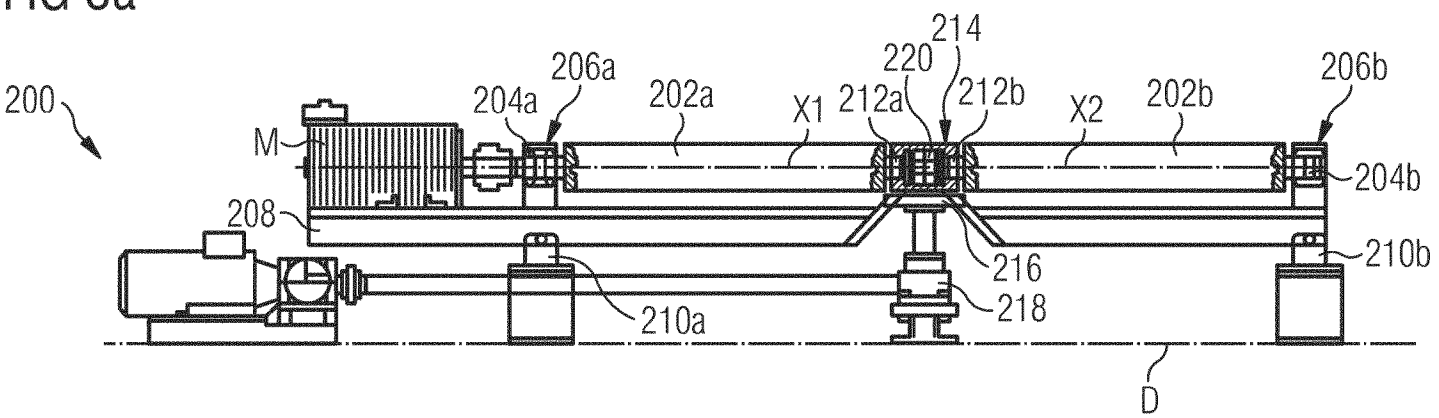
FIGS. 3*a* and 3*b* show embodiments of roller table apparatus in accordance with the present invention.

Referring to FIG. 3*a*, a roller table apparatus 200 for transporting a product comprises a pair of half-width cylindrical rolls 202*a*, 202*b*. In the condition shown the respective longitudinal axes X1, X2 of the rolls 202*a*, 202*b* are parallel with a datum D which represents the horizontal ground on which the roller table apparatus 200 is supported. That is, the angle of inclination, between the ground and the longitudinal axis X1, X2 of each of the half-width cylindrical rolls 202*a*, 202*b*, is zero. In this embodiment, the half-width cylindrical rolls 202*a*, 202*b* are arranged in line, and the respective longitudinal axes X1, X2 of the rolls 202*a*, 202*b* lie in the same plane (i.e. the axes X1, X2 are coplanar). Alternatively, the half-width cylindrical rolls 202*a*, 202*b* may be spaced apart (staggered) so that the respective longitudinal axes X1, X2 lie in two different planes which are parallel with each other.

Each of the rolls 202*a*, 202*b* has an outboard end which is supported by a conventional outboard bearing 204*a*, 204*b* in an outboard bearing housing 206*a*, 206*b* that is mounted on a pivotable frame assembly 208. The pivotable frame assembly 208 is located on mounting points 210*a*, 210*b* of a foundation mounted fabricated steel frame. Pivot points are located directly above the mounting points 210*a*, 210*b*. Alternatively, the pivot points may be offset, either inboard or outboard of the mounting points 210*a*, 210*b*, in order to optimize the geometry to minimize the pass-line height variation, as described later herein.

The inboard ends of the half-width rolls 202*a*, 202*b* are received by respective inboard bearings 212*a*, 212*b* disposed within an inboard self-aligning bearing housing 214. The self-aligning bearing housing 214 is supported on a central adjustable support 216 which is arranged to be moved up and down by an actuator 218. In this embodiment, the inboard bearing housing 214 is fixed to the adjustable central support 216. A connection between the pivotable frame assembly 208 and the adjustable central support 216 comprises slotted holes and pins so that a change of angle (inclination) of the half-width cylindrical rolls 202*a*, 202*b* can be accommodated. Alternatively, the slotted holes may be located at the outboard ends and the pivots at the inboard ends. The function of the slotted holes may instead be provided by an alternative component, for example a small link.

The inboard bearings 212*a*, 212*b* are arranged to take up a range of angles within the self-aligning bearing housing 214. In this embodiment, the inboard bearings 212*a*, 212*b* comprise cylindrical roller bearings which allow for axial movement of the inboard ends of the rolls 202*a*, 202*b* to accommodate the range of angles and also thermal expansion of the rolls 202*a*, 202*b*. The self-aligning bearing housing 214 includes seals to protect the inboard bearings 212*a*, 212*b* and prevent bearing lubricant from escaping and contaminating the product which is to be transported. In an alternative embodiment, the inboard ends of the rolls 202*a*, 202*b* are supported by respective self-aligning bearings within a conventional housing.

In order that the two half-width rolls 202*a*, 202*b* can be driven by a single motor M and to avoid any cyclical speed variations between the two halves, in this embodiment, they are connected by a constant velocity type joint 220. Preferably, in order to achieve angles which are greater than are normally possible with gear type couplings, this joint is a gear type joint with an over-crowned hub, but other types of constant velocity joint could be used. Preferably, as illustrated, the joint 220 is contained within the same inboard self-aligning bearing housing 214 as the inboard bearings 212*a*, 212*b* so that the same lubrication system and seals are common to both. At least one of the rolls 202*a*, 202*b* has a splined connection to the joint 220 in order to accommodate the small axial movements caused by the angle change. In an alternative arrangement, the inboard ends of the rolls 202*a*, 202*b* are fixed and cylindrical bearings are provided at the outboard ends of the rolls 202*a*, 202*b* with a splined coupling to the motor M, to accommodate the axial displacement.

The motor M is mounted on an extension of the pivotable frame assembly 208 and connected to the (in the sense of FIGS. 3*a* and 3*b*, left-hand) half-width roll 202*a* by a conventional shaft coupling. Alternatively, the motor M may be fixedly mounted on the floor or on the foundation mounted fabricated steel frame, although this would require a drive shaft between the motor M and the roll 202*a* which included constant velocity joints capable of accepting large changes in angle.

Figure 3B:
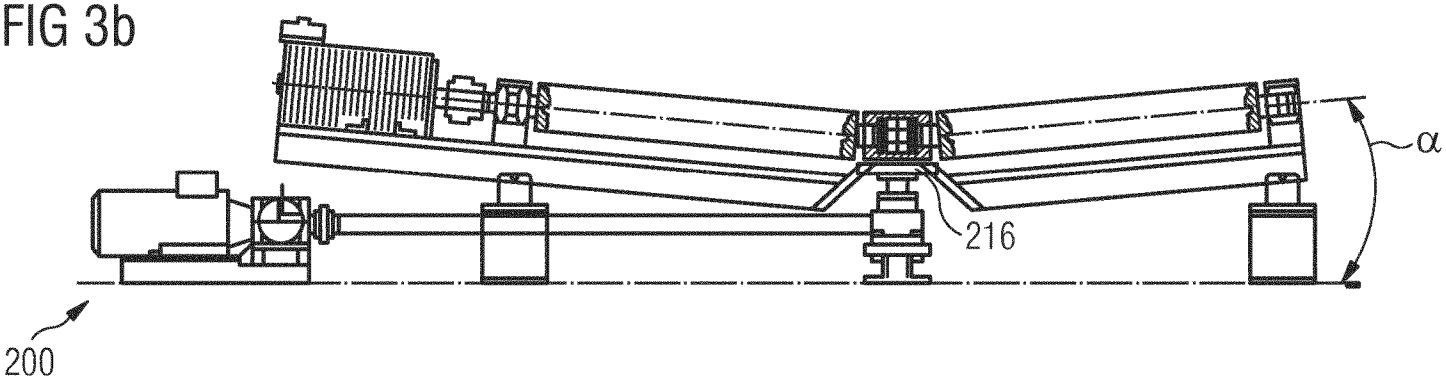

Referring now to FIG. 3*b*, in use the angle α of inclination of the half-width cylindrical rolls 202*a*, 202*b* (or the longitudinal axes X1, X2 thereof), with respect to the datum D (the ground), is adjusted by changing the height of the central support 216 using the actuator 218. In the condition shown, the rolls 202*a*, 202*b* have been displaced by the adjustment such that the angle α of inclination is 5 degrees, but it will be understood that the angle α may take any appropriate value which allows the support and transport of a product by the roller table apparatus 200.

Figure 4A:
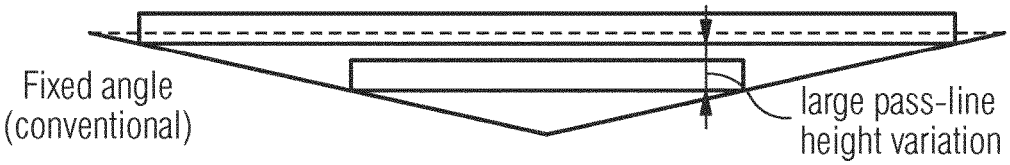
FIGS. 4*a* and 4*b* illustrate an effect of the inventive roller table apparatus.
Figure 4B:
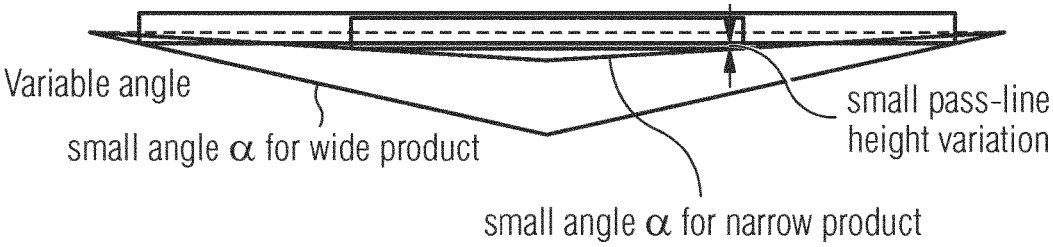

Turning now to FIGS. 4*a* and 4*b*, it will be seen that this adjustment, of the inclination of the rolls 202*a*, 202*b*, advantageously provides a reduction in pass-line height variation with product width (the pass-line height being taken as the distance between the bottom surface of the product and floor level). As discussed herein above, the sag of the product is a function of the product width; that is wide products sag more than narrow products. With a conventional fixed angle roller table (see FIG. 4*a*) a relatively steep angle is required in order to handle the thinnest and widest product. But, with the "variable angle" roller table apparatus of the present invention (see FIG. 4*b*) it is possible to choose a relatively shallow angle for narrower products and a steeper angle for wider products.

In principle, by making the angle directly proportional to the width of the product, the pass-line height variation would be zero, but in practice the sag of the material changes the effective pass-line height as well. As discussed herein above, however, the sag can be calculated and so in theory it is possible to virtually eliminate the pass-line height variation. Even if there are other considerations, e.g. the fact that on very thin and wide plate products the material could not support itself from the edges only, it is clear that the variable angle roller table apparatus can at least significantly reduce the pass-height variation for most products.

The adjustment of the table roll angle would take place immediately before rolling a pass and hence the optimum angle can be set dependent on the product thickness, width and strength.

In the case of strip products and the thicker and narrower plate products, the material can be rolled with support at the edges only and with minimal pass-line height variation. In the case of the thinnest and widest plate products, which cannot support themselves from the edges only, the earlier passes and shearing operations can be done with roller angles which support the material at the edges only but the last finishing passes can be done with small or even zero roller angles.

In the case of a 1+1 or similar mill with sections of roller tables having different widths, it is important that there is no change in pass-line height as the material transfers from the wide table to the narrow roller table. If the narrower roller table has a fixed angle, then this can easily be achieved by ensuring that when the variable angle wide roller table is set at this same angle, then the pass-line heights for the two sections are matched. However, if the narrower roller table has adjustable angles, then matching the wide and narrow tables can only be achieved by ensuring that the outboard pivot points for both the narrow and the wide tables are at the same position. This requires either offsetting the pivot points for the wide tables inwards or offsetting the pivot points for the narrow tables outwards or a combination of the two.

Figure 5A:
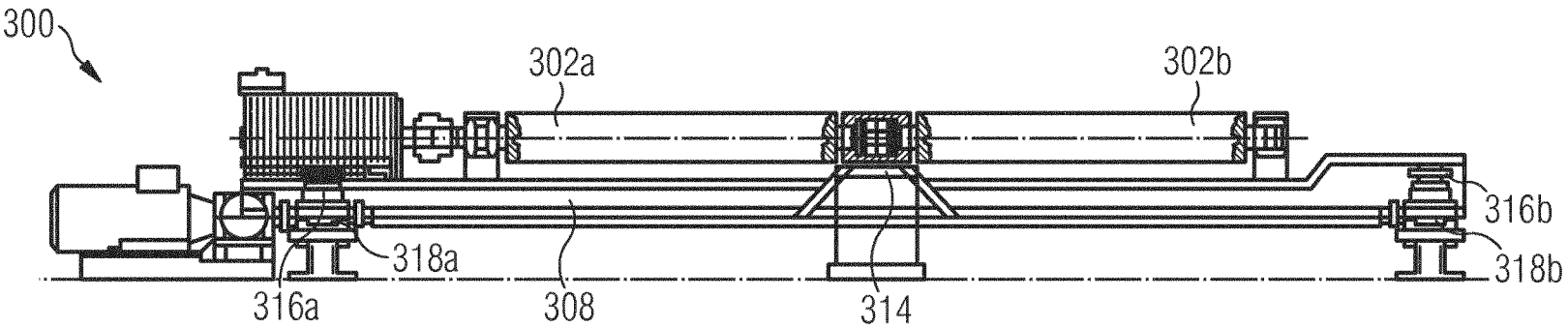
FIGS. 5*a* and 5*b* show an alternative embodiment of the inventive roller table apparatus.
Figure 5B:
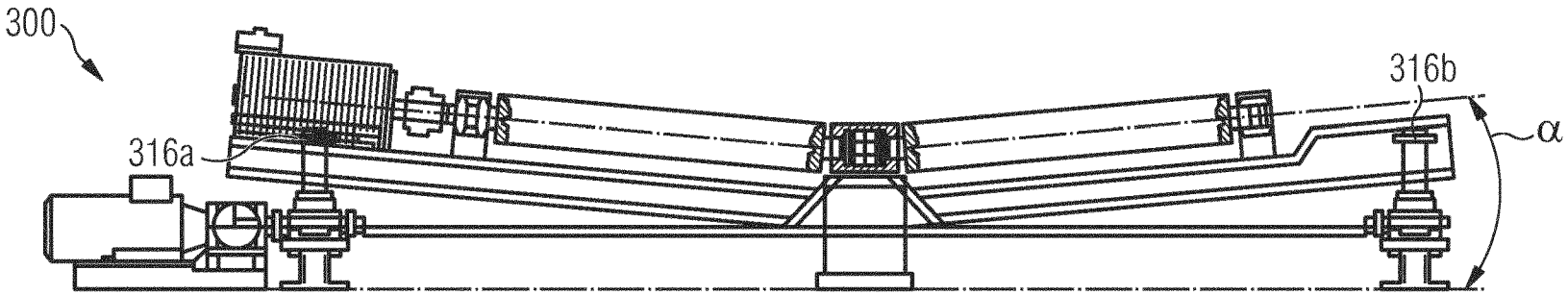

Referring to FIGS. 5*a* and 5*b*, in an alternative embodiment of the inventive roller table apparatus 300, a central support 314 is set at a fixed height while a pair of adjustable outboard supports 316*a*, 316*b* is provided for supporting respective outboard end portions of the pivotable frame assembly 308. Each of the outboard supports 316*a*, 316*b* is arranged to be moved up and down by a respective actuator 318*a*, 318*b*, in order to raise and lower the outboard ends of the pivotable frame assembly 308 and thereby vary the angle α of inclination of the half-width cylindrical rolls 302*a*, 302*b*. In the case of a 1+1 mill with both wide and narrow roller tables, it is easy to match the tables when they are at the same angle, so long as the central support is at the same position for the two tables. On the other hand, the pass-line height variation is greater unless very steep roller angles are used on narrow products.

In another embodiment (not shown in the Figures), height adjustment is provided with respect to both the central support and the outboard supports. This has the advantage of allowing independent control of the roller angle and the pass-line height but may make the system more complex and expensive.

In the above-described embodiments, each of the actuators 218; 318*a*, 318*b* comprises a screw jack but other means, such as a hydraulic cylinder, could be used. In an embodiment, one single actuator is configured to operate a mechanism which raises and/or lowers (adjusts) central and/or outboard supports in connection with multiple pairs of half-width cylindrical rolls. The supports may also be guided so that the screw-jack or other actuator mechanism does not have to withstand any side loads.

In the above-described embodiments, each of the half-width rolls 202*a*, 202*b*; 302*a*, 302*b* may be solid, and therefore especially suited to heavier duty areas such as next to the mill stand, or hollow, and therefore especially suited for lighter duty areas such as distant from the mill stand.

While the present invention is particularly appropriate for use with aluminium products, the invention may also be useful in the rolling of products made from other metallic materials.

It will be understood that the invention has been described in relation to its preferred embodiments and may be modified in many different ways without departing from the scope of the invention as defined by the accompanying claims.

The invention claimed is:

1. A roller table apparatus for transporting a metallic product to or from a mill stand, the roller table apparatus comprising:

first and second rolls positioned and configured to transport the metallic product by direct contact with the metallic product, each roll having a respective longitudinal axis, outboard ends of the rolls being supported by respective outboard bearings and inboard ends of the rolls being supported by respective inboard bearings, such that each of the rolls is rotatable about its longitudinal axis, at least one adjuster configured to move in use to displace the rolls so as to adjust an angle of inclination of each of the longitudinal axes of the rolls with respect to a datum, thereby to adjust a pass-line height of the metallic product relative to the datum;

wherein the rolls are displaced such that the first rolls extend outward from their respective inboard bearings with axes having a first angle of inclination, while the second rolls extend outward from their respective inboard bearings with axes having a second angle of inclination, the longitudinal axes of the second rolls not being parallel to the longitudinal axes of the first rolls;

at least one motor is arranged and configured to rotate the rolls.

2. A roller table apparatus according to claim 1, wherein the first and second rolls are arranged in line such that the respective longitudinal axes of the rolls lie on a common plane.

3. A roller table apparatus according to claim 1, wherein the first and second rolls are spaced apart such that the respective longitudinal axes of the rolls lie in parallel planes.

4. A roller table apparatus according to claim 1, comprising a pivotable support frame which supports the rolls and is arranged to pivot in order to accommodate the displacement of the rolls.

5. A roller table apparatus according to claim 4, wherein the pivotable support frame is connected to the at least one adjuster.

6. A roller table apparatus according to claim 5, wherein the at least one adjuster is located at a central portion of the pivotable support frame so as to displace the inboard ends of the rolls.

7. A roller table apparatus according to claim 5, comprising first and second ones of the adjusters which are located at respective first and second outboard portions of the pivotable support frame so as to displace the outboard ends of the rolls.

8. A roller table apparatus according to claim 5, comprising:

a first one of the adjusters, located at a central portion of the pivotable support frame so as to displace the inboard ends of the rolls; and second and third ones of the adjusters, located at respective outboard portions of the pivotable support frame so as to displace the outboard ends of the rolls.

9. A roller table apparatus according to claim 8, wherein the inboard bearings are mounted on respective inboard portions of the pivotable support frame and the at least one adjuster is arranged to accommodate the displacement of the rolls.

10. A roller table apparatus according to claim 4, wherein the motor is located on the pivotable support frame or on an extension thereof.

11. A roller table apparatus according to claim 10, wherein the rolls are connected by a constant velocity joint.

12. A roller table apparatus according to claim 11, further comprising a splined connection between the first and second rolls being configured for accommodating axial movement of the rolls caused by the displacement.

13. A roller table apparatus according to claim 1, comprising a self-aligning bearing housing which houses the inboard bearings and is arranged to accommodate the displacement of the rolls.

14. A roller table apparatus according to claim 1, further comprising at least one actuator for moving the at least one adjuster to displace the rolls.

15. A roller table apparatus according to claim 1, wherein the rolls are of solid construction.

16. A roller table apparatus according to claim 1, wherein the rolls are of hollow construction.

17. A roller table apparatus according to claim 1, wherein the rolls comprise cylindrical rolls.

18. A roller table for use with a mill stand, comprising plural roller table apparatus according to claim 1.

19. The roller table apparatus as claimed in claim 1, wherein when the rolls are displaced the angle of inclination of the longitudinal axes of the first rolls is equal to the angle of inclination of the longitudinal axes of the second rolls.

20. The roller table apparatus as claimed in claim 1, wherein the inboard bearings of a respective roll of the first rolls are positioned adjacent the inboard bearings of a respective roll of the second rolls.

21. A method of using a roller table apparatus for transporting a metallic product to or from a mill stand, the roller table apparatus comprising:

first and second rolls positioned and configured to transport the metallic product by direct contact with the metallic product, outboard ends of the rolls being supported by respective outboard bearings and inboard ends of the rolls being supported by respective inboard bearings, such that each of the rolls is rotatable about its longitudinal axis; and at least one adjuster moving in use to displace the rolls so as to adjust an angle of inclination of each of the longitudinal axes of the rolls with respect to a datum thereby to adjust a pass-line height of the product relative to the datum; and the method comprising:

moving the adjuster in order to adjust angles of inclination of the longitudinal axes of the first and second rolls according to one or more of the width, thickness, grade and temperature, of the metallic product, such that the first rolls have longitudinal axes at a first angle of inclination, while the second rolls have longitudinal axes at a second angle of inclination, the longitudinal axes of the second rolls not being parallel to the longitudinal axes of the first rolls, wherein at least one motor is arranged to rotate the rolls.

* * * * *